US006626151B2

(12) United States Patent
Boehm et al.

(10) Patent No.: US 6,626,151 B2
(45) Date of Patent: Sep. 30, 2003

(54) FUEL-INJECTION VALVE FOR INTERNAL COMBUSTION ENGINES

(75) Inventors: Martin Boehm, Stuttgart (DE); Rainer Haeberer, Bretten (DE); Helmut Clauss, Eberdingen (DE); Felix Landhaeusser, Notzingen (DE); Markus Rueckle, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/030,635

(22) PCT Filed: May 8, 2001

(86) PCT No.: PCT/DE01/01732

§ 371 (c)(1),
(2), (4) Date: Apr. 15, 2002

(87) PCT Pub. No.: WO01/88368

PCT Pub. Date: Nov. 22, 2001

(65) Prior Publication Data

US 2002/0134355 A1 Sep. 26, 2002

(30) Foreign Application Priority Data

May 13, 2000 (DE) ..... 100 23 621

(51) Int. Cl.[7] ..... F02M 59/46
(52) U.S. Cl. ..... 123/458; 251/129.02
(58) Field of Search ..... 123/495, 497, 123/506, 450, 458; 251/129.02

(56) References Cited

U.S. PATENT DOCUMENTS 5,099,814 A * 3/1992 Ament ..... 123/450
5,239,968 A * 8/1993 Rodriquez-amaya et al. .... 123/506
5,429,154 A * 7/1995 Kato ..... 251/129.16
5,810,328 A * 9/1998 Boehland ..... 251/129.02
2001/0029930 A1 * 10/2001 Banshaf ..... 123/458

* cited by examiner

*Primary Examiner*—Thomas N. Moulis
(74) *Attorney, Agent, or Firm*—Ronald E. Greigg

(57) ABSTRACT

A fuel injection system for internal combustion engines, has a distributor tube and a high-pressure pump which is driven as a function of engine rpm and serves to generate the fuel pressure and fuel throughput required in the distributor tube in the applicable operating state of the engine, and also has a fuel metering unit, which is assigned to the high-pressure pump and is based on an electromagnetically actuated regulating valve. The fuel metering unit is disposed in the high-pressure pump, and the outlet of the regulating value discharges into the low-pressure region of the high-pressure pump. The inlet of the regulating valve communicates with the compression side of a prefeed pump. The regulating valve has a valve piston, which is actuated—into the opening position—by a compression spring and which is actuatable counter to the spring force—into the closing position—by an armature bolt of the electromagnet. Valve piston has at least one and preferably more radial control openings, which are in operative communication with the intake side of the high-pressure pump.

21 Claims, 2 Drawing Sheets

Fig. 2
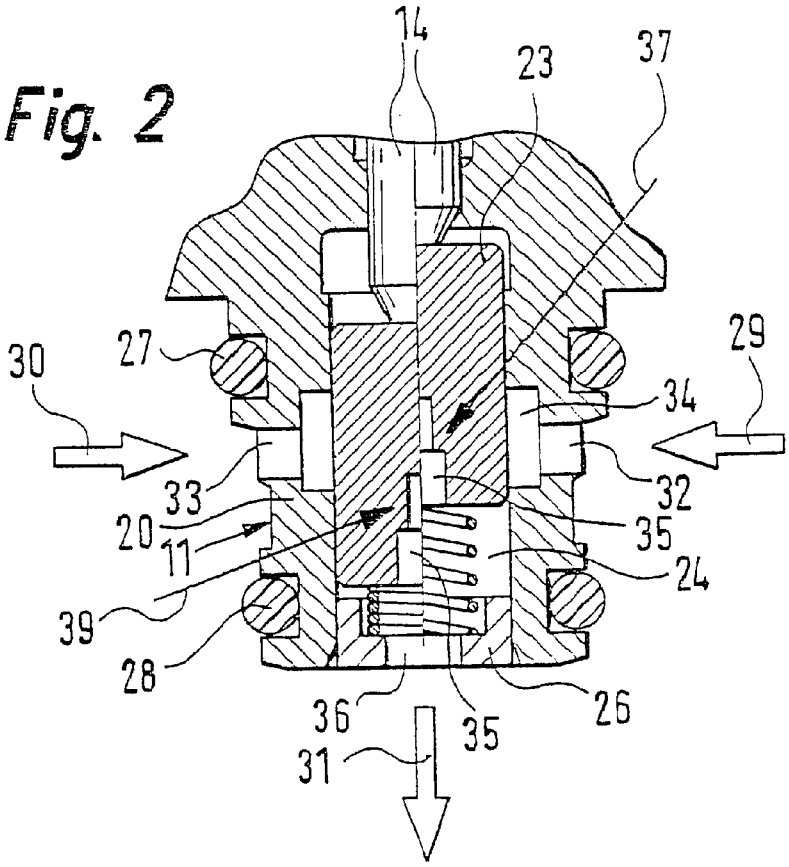
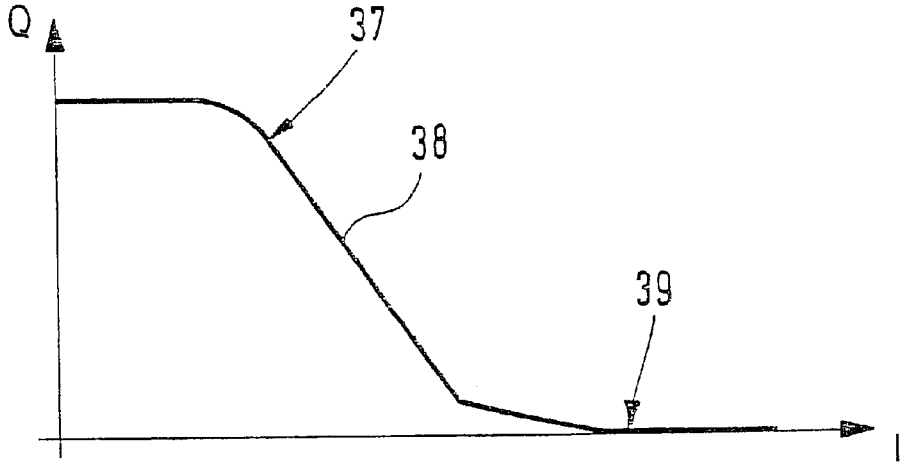
Fig. 3

FUEL-INJECTION VALVE FOR INTERNAL COMBUSTION ENGINES

CROSS-REFERENCE TO RELATED APPLICATIONS

This application is a 35 U.S.C. 371 application of PCT/DE 01/01732, filed on May 8, 2001.

BACKGROUND OF THE INVENTION

1. Field of the Invention

The invention relates to a fuel injection system for internal combustion engines.

2. Description of the Prior Art

The subject of German Application DE 19853103.6 is distinguished by a fuel metering unit which is capable of metering exactly the desired fuel quantity in the applicable operating state of the engine to the high-pressure pump of the common rail (CR) system. By this kind of exact metering on the low-pressure region of the required fuel quantity to the high-pressure pump, compressed overflows are averted from the very outset, which leads to improved efficiency and thus to fuel economies.

In the subject of the above-referenced German Application DE_19853103.6, radial control openings in the valve housing and an axial opening that leads to the interior of the sleevelike valve piston are essential structural elements. Under these structural preconditions, the aforementioned advantages can be achieved by means of two alternative flow principles: In one alternative, the axial opening connects the interior of the valve piston to a prefeed pump of the fuel injection system, and the radially oriented control openings of the valve housing operatively communicate hydraulically with the low-pressure region of the high-pressure pump. In the other alternative, this flow principle is reversed; now the axial opening communicates hydraulically with the low-pressure region of the high-pressure pump, while the control openings communicate with the compression side of the prefeed pump and thus form the inflow into the metering unit.

SUMMARY OF THE INVENTION

The object of the present invention is to further optimize this latter, "reversed" flow principle.

According to the invention, one advantage is that the valve piston in the valve housing is hydraulically centered over 360°, especially whenever a suitable annular conduit is embodied in the valve housing. In this way, sliding with little hysteresis and hence optimal sliding of the valve piston in the valve housing is made possible.

By disposing the control openings at equal angular spacings on the circumference of the valve piston, preferably in diametrically opposed pairs, an optimal hydraulic flow force compensation is attained.

From a production standpoint as well, the invention proves to be advantageous, since it is in fact simpler and less complicated to machine the control openings (for instance by laser cutting and ensuing deburring) in the valve piston than would be the case in what is already a cost-intensive valve housing. The variation from one application to another in the control openings accordingly takes place in the valve piston and not in the cost-intensive valve housing.

BRIEF DESCRIPTION OF THE DRAWINGS

For the sake of more detailed explanation of the invention, an exemplary embodiment is used, and is described in further detail below in conjunction with the drawings, in which:

FIG. 2 is an enlarged view of the detail marked "A" in; and

FIG. 3 is a graph in which the fuel throughput (Q) is plotted over the magnet stroke (I).

DESCRIPTION OF THE PREFERRED EMBODIMENTS

Figure 1:
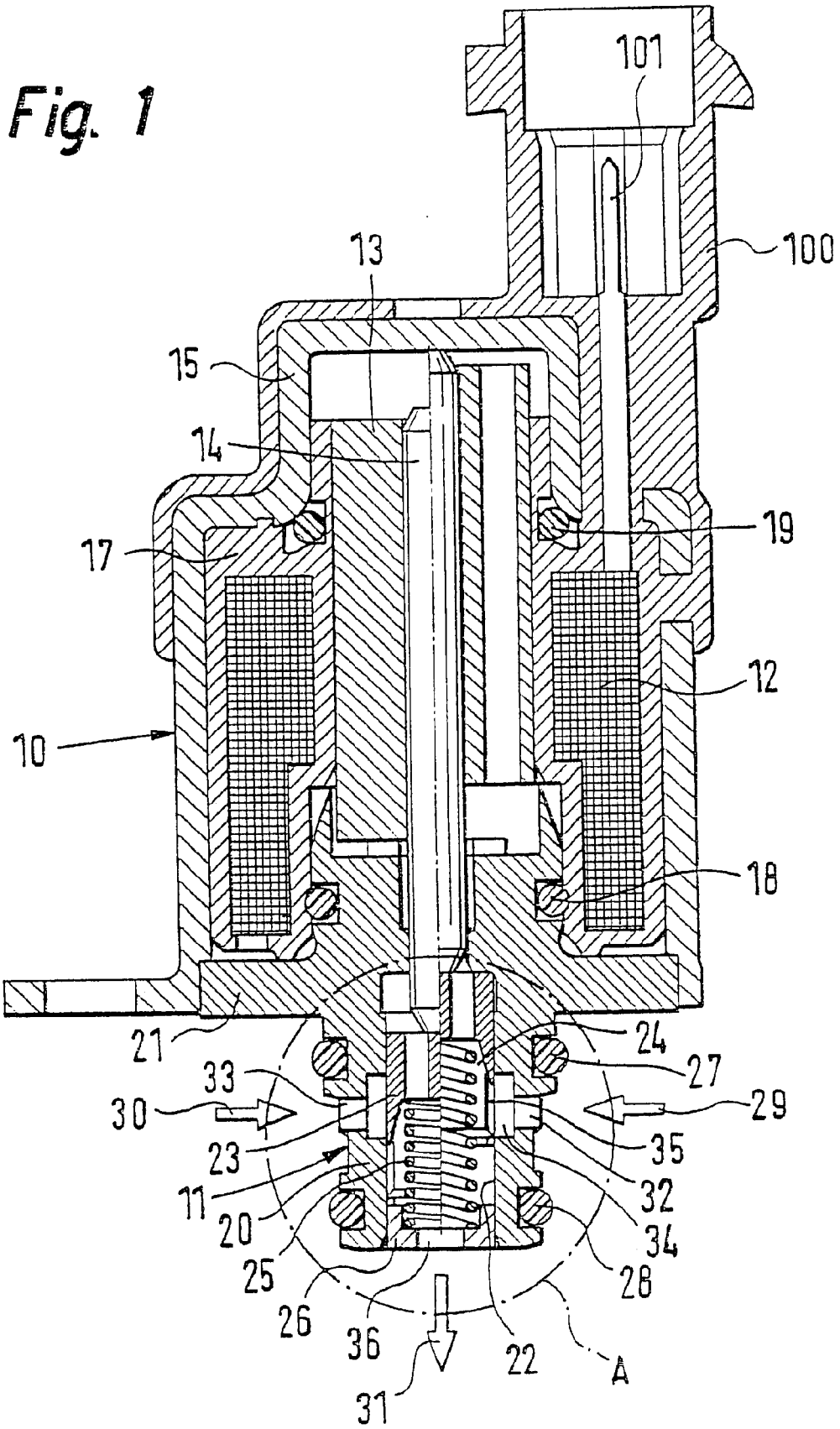
FIG. 1 is a vertical longitudinal section of one embodiment of a fuel metering unit.

In FIG. 1 and—in part—also in FIG. 2, reference numeral 10 designates an electromagnet with an integrated regulating valve 11. The electromagnet 10 has a magnet coil 12, an armature 13 with an armature bolt 14, and a magnet cup 15. The magnet cup partly surrounds the magnet coil 12 and the armature 13.

A pluglike current connection 101 is provided in a plug housing 100 joined integrally to the magnet cup 15. The structural unit comprising the electromagnet 10 with the integrated regulating valve 11 is integrated with a fuel high-pressure pump (not shown). Optimal heat transfer from the coil 12 to the housing 15 is assured by means of a sprayed coating 17. Two sealing points 18, 19, together with the magnet coil 12, assure that the magnet coil winding and contact points of the coil 12 are protected optimally against the attack of corrosive media.

The regulating valve 11 has a valve housing 20, which changes over into a flangelike widened portion 21 that at the same time forms the face-end termination of the electromagnet housing 15. An axial bore 22 that is disposed coaxially to the armature bolt 14 of the electromagnet 10 is made in the valve housing 20. The axial bore 22 receives a displaceable, sleevelike valve piston 23, in whose interior 24 a compression spring 25 is disposed. The compression spring 25 is braced on the inside on the valve piston 23, and it is braced by its other end on a securing element 26 located in the axial bore 22 of the valve housing 20. On the outside, the valve piston 23 is in contact with the front end of the armature bolt 14.

The regulating valve 11 is sealed off from the material, which has a fuel inflow conduit, of the high-pressure pump (not shown) by two sealing rings 27, 28.

Two arrows 29, 30 represent the fuel inflow to the regulating valve 11, and an arrow 31 marks the fuel outflow from the regulating valve 11. The arrows 29, 30, 31 thus at the same time mark the so-called "reversed" flow principle chosen in the fuel metering device shown. For that purpose, the valve housing 20 has a plurality of radially disposed, preferably oppositely paired inlet openings 32, 33, which are in hydraulic operative communication with a prefeed pump (not shown) of the fuel injection system. The inlet openings 32, 33 discharge into an annular conduit 34. Radial control openings 35 are disposed in the valve piston 23 and cooperate with the annular conduit 34 and the inlet openings 32, 33, in that—depending on the position of the valve piston 23 (in this respect see the two possible piston positions, each shown in half the drawing, in FIGS. 1 and 2)—they uncover or close the inflow into the valve interior 22, 24.

The fuel that reaches the valve interior 22, 24 is diverted in the axial direction (arrow 31) through an offset bore 36, which communicates hydraulically with the high-pressure pump inflow (low-pressure region of the high-pressure pump). The bore 36 is machined into the aforementioned securing element 26, which forms the lower termination of the valve housing 20.

FIG. 2 shows the special shaping of the control opening 35, from which—in cooperation with the reciprocating motion of the valve piston 23—the throughput characteristic shown in graph form in FIG. 3 is obtained. The control opening 35 preferably has one (upper) slitlike region and one (lower) approximately rectangular region. In the upper terminal position (opening position) of the valve piston 23—see the right half of the drawing in FIG. 2 (or FIG. 1, respectively)—the widened rectangular region of the control opening 35 comes into play. This means a maximum fuel throughput through the valve 11. This state is indicated by an arrow 37 in both FIG. 2 and FIG. 3.

During the downward motion of the valve piston 23, the throughput decreases steadily (see the left curve segment 38 in FIG. 3). In the lower terminal position (closing position) of the valve piston 23, finally (see the left half of the drawing in FIGS. 2 and 1), the throughput has decreased to zero (see arrows 39 in FIGS. 2 and 3).

As an alternative to the geometry shown in FIG. 2 and described above for the control opening 35, however, still other kinds of shaping of the control opening 35 are entirely possible. For instance, it is conceivable to make the control opening trapezoidal or such that it follows the characteristic of an e-function and thus to achieve other throughput characteristics, such as linear ones. The throughput characteristic visible from FIG. 3, conversely, is distinguished by a graduated course.

The foregoing relates to preferred exemplary embodiments of the invention, it being understood that other variants and embodiments thereof are possible within the spirit and scope of the invention, the latter being defined by the appended claims.

We claim:

1. A fuel injection system for internal combustion engines, comprising a distributor tube and a high-pressure pump which is driven as a function of engine rpm and serves to generate the fuel pressure and fuel throughput required in the distributor tube in the applicable operating state of the engine, and a fuel metering unit, which is assigned to the high-pressure pump and is based on an electromagnetically actuated regulating valve, wherein the fuel metering unit (10, 11) is disposed in the high-pressure pump, the outlet (36) of the regulating valve (11) discharges into the low-pressure region of the high-pressure pump, and the inlet (32, 33) of the regulating valve (11) communicates with the compression side of a prefeed pump, and wherein the regulating valve (11) has a valve piston (23), which is actuated—into the opening position—by a compression spring (25) and which is actuatable counter to the spring force—into the closing position—by an armature bolt (14) of the electromagnet (10), wherein in the valve piston (23), having at least one and preferably more radial control openings (35), which are in operative communication with the intake side of the high-pressure pump.

2. The fuel injection system of claim 1, wherein the valve housing (20) has an annular conduit (34) and a plurality of radially disposed, preferably oppositely paired inlet openings (32, 33), which serve the purpose of fuel inflow (arrows 29, 30) into the valve piston (23), in such a way that they are in operative communication with the control openings (35) of the valve piston (23) via the annular conduit (34).

3. The fuel injection system of claim 1, wherein the interior (24) of the sleevelike valve piston (23) simultaneously serves the purpose of axially diverting the fuel out of the regulating valve (11) in the direction (arrow 31) of the high-pressure pump inflow.

4. The fuel injection system of claim 2, wherein the interior (24) of the sleevelike valve piston (23) simultaneously serves the purpose of axially diverting the fuel out of the regulating valve (11) in the direction (arrow 31) of the high-pressure pump inflow.

5. The fuel injection system of claim 2, wherein the control openings (35) are disposed at equal angular spacings on the circumference of the valve piston (23), preferably oppositely paired.

6. The fuel injection system of claim 3, wherein the control openings (35) are disposed at equal angular spacings on the circumference of the valve piston (23), preferably oppositely paired.

7. The fuel injection system of claim 4, wherein the control openings (35) are disposed at equal angular spacings on the circumference of the valve piston (23), preferably oppositely paired.

8. The fuel injection system of claim 2, wherein the control openings (35) have one (upper) slitlike and one (lower) widened, approximately rectangular region (FIG. 2).

9. The fuel injection system of claim 3, wherein the control openings (35) have one (upper) slitlike and one (lower) widened, approximately rectangular region (FIG. 2).

10. The fuel injection system of claim 4, wherein the control openings (35) have one (upper) slitlike and one (lower) widened, approximately rectangular region (FIG. 2).

11. The fuel injection system of claim 5, wherein the control openings (35) have one (upper) slitlike and one (lower) widened, approximately rectangular region (FIG. 2).

12. The fuel injection system of claim 6, wherein the control openings (35) have one (upper) slitlike and one (lower) widened, approximately rectangular region (FIG. 2).

13. The fuel injection system of claim 7, wherein the control openings (35) have one (upper) slitlike and one (lower) widened, approximately rectangular region (FIG. 2).

14. The fuel injection system of claim 2, wherein the control openings have a trapezoidal shape.

15. The fuel injection system of claim 3, wherein the control openings have a trapezoidal shape.

16. The fuel injection system of claim 4, wherein the control openings have a trapezoidal shape.

17. The fuel injection system of claim 5, wherein the control openings have a trapezoidal shape.

18. The fuel injection system of claim 2, wherein the control openings are embodied as obeying the characteristic of an e-function.

19. The fuel injection system of claim 3, wherein the control openings are embodied as obeying the characteristic of an e-function.

20. The fuel injection system of claim 4, wherein the control openings are embodied as obeying the characteristic of an e-function.

21. The fuel injection system of claim 5, wherein the control openings are embodied as obeying the characteristic of an e-function.

* * * * *